United States Patent [19]

Kawamura et al.

[11] 4,280,452

[45] Jul. 28, 1981

[54] ENGINE START ENHANCEMENT DEVICE

[75] Inventors: Hideo Kawamura, Yamato; Takahiko Itou, Tokyo, both of Japan

[73] Assignee: Isuzu Motors Ltd., Tokyo, Japan

[21] Appl. No.: 74,948

[22] Filed: Sep. 13, 1979

[30] Foreign Application Priority Data

Sep. 19, 1978 [JP] Japan ..... 53/114879

[51] Int. Cl.[3] ..... F02N 17/00; F02P 19/02

[52] U.S. Cl. ..... 123/179 BG; 123/145 A; 123/179 H; 219/499

[58] Field of Search ..... 123/179 BG, 179 H, 145 A; 219/499; 361/264

[56] References Cited

U.S. PATENT DOCUMENTS

| | | | |
|---|---|---|---|
| 3,789,190 | 1/1974 | Orosy et al. | 219/499 X |
| 3,845,274 | 10/1974 | Krenke et al. | 219/499 |
| 3,866,587 | 2/1975 | Knapp | 219/499 X |
| 4,196,712 | 4/1980 | Kawamura et al. | 123/145 A X |

*Primary Examiner*—Tony M. Argenbright

*Attorney, Agent, or Firm*—Sughrue, Rothwell, Mion, Zinn and Macpeak

[57] ABSTRACT

A device for enhancing the starting of a diesel engine in which the current flow to the glow plugs of the engine during the warm-up time is controlled so as to heat the engine as quickly as possible without damage to the glow plugs. Each glow plug is connected in series with a low value resistance between an output terminal of the relay and one of the battery terminals. Also connected across the output terminal of the relay and the output battery terminal is a series combination of three resistors one of which is in thermal contact with the first resistor. A comparator is connected to the middle points of the Wheatstone bridge circuit thus formed. Relay operating means is provided to open the relay contacts when an output signal is produced by the comparator indicating that the glow plug temperature is sufficiently high. On-off cycling of the current flow to the glow plug is continued until the engine is ready to start.

5 Claims, 2 Drawing Figures

ENGINE START ENHANCEMENT DEVICE

BACKGROUND OF THE INVENTION

The present invention relates to a device for enhancing the starting of diesel engines.

In most conventional diesel engines, especially in diesel engines having a preheating or swirl chamber, the engines are started using glow plugs. Utilization of glow plugs is advantageous in that the required device is simple and the engine can be readily started. However, this technique is still disadvantageous in that it takes 20 to 30 seconds to preheat the glow-plug so that consequently the engine starting characteristics are generally thought to be quite poor.

SUMMARY OF THE INVENTION

In order to eliminate the above-noted drawbacks inherent in the prior art preheating technique, an object of the present invention is to provide an engine start enhancement device for diesel engines wherein the period of time required for preheating the engine using glow plugs is considerably reduced while the heat generating elements of the glow plugs are prevented from fusing or melting due to excessive current flow.

These, as well as the other objects of the invention may be met by a start enhancement device for operating the glow plugs of the diesel engine and the like including a relay connected to switch current from a first terminal of the battery, a first resistor connected in series with a heating element of the glow plug with the resulting series combination thereof being connected between an output terminal of the relay and a second terminal of the battery, second, third and fourth resistors coupled in series with one another with the third resistor thermally coupled to the first resistor and with the third resistor having a temperature coefficient of resistance corresponding to the temperature coefficient of resistance of the first resistor with the series combination of the second, third and fourth resistors coupled between the output terminal of the relay and the second terminal of the battery with a first terminal of the fourth resistor coupled to the same terminal as one terminal of the heating element of the glow plug, comparator means with one input terminal coupled to the juncture between the first resistor and the glow plug with a second input terminal coupled to a second terminal of the fourth resistor, and means for operating the relay in response to an output signal produced by the comparator means. The resistance value of the first resistor is preferably substantially less than the resistance value of the glow plug and, may for example, be 1/10 as large. The first resistor may comprise a section of wire made of copper or copper alloy. A body of electrically insulating and at least partially thermally conducting material may be provided covering at least portions of the first and third resistors putting them in thermal contact with one another.

The resistors thus connected form a bridge circuit with the comparator connected to middle points of the bridge circuit. The output signal is produced when $$(r_2+r_3)/r_1 \geqq r_4/R$$

where $r_1$–$r_4$ are the resistance values of the first through fourth resistors respectively and R is the resistance value of the heating element of the glow plug. Both the heating element of the glow plug and the third resistor have a positive temperature coefficient.

One embodiment of the invention will hereinafter be described in reference to the accompanying drawings.

DESCRIPTION OF THE PREFERRED EMBODIMENT

Figure 1:
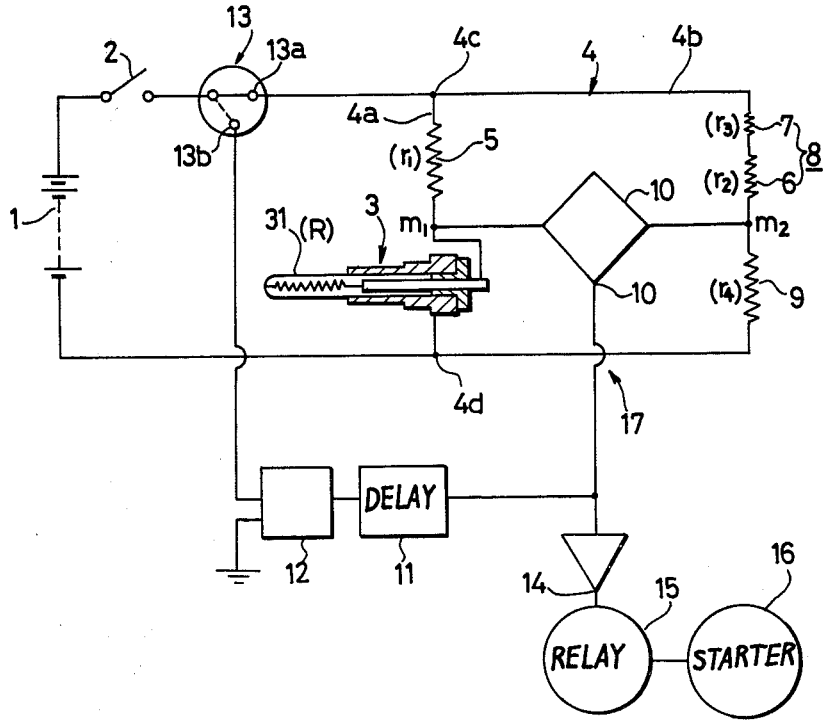
FIG. 1 is a schematic diagram showing an embodiment of the present invention.

FIG. 1 shows a start enhancement device for a diesel engine in which reference numeral 1 designates a power supply, reference numeral 2 a key switch, and reference numeral 3 a glow plug one of which is provided for each cylinder. Reference numeral 31 indicates a metallic resistance material having a resistance value at a set temperature Ts determined for promoting combustion in the combustion chamber. To this effect, a resistance value Rs is chosen to produce heating to the set temperature for a fixed input voltage.

Reference numeral 4 designates a bridge circuit, for example, a Wheatstone bridge circuit. Within bridge circuit 4, a first resistor 5 having an extremely small resistance $r_1$ at room temperature and a positive temperature coefficient and the heat generating element 31 of the glow plug 3 are connected in series in one line 4*a*. A second resistor 6 having a predetermined constant resistance $r_2$ and a third resistor 7 having a positive temperature coefficient resistance $r_3$ corresponding to the temperature-induced variation in resistance of the first resistor 5 are connected in series to form a resultant resistor 8. The resultant resistor 8 and a fourth resistor 9 having a predetermined resistance $r_4$ are connected in series in the other line 4*b*. Both lines 4*a* and 4*b* are connected at common ends 4*c* and 4*d* to complete the Wheatstone bridge 4. It is desirable to utilize for the first resistor 5 a resistor made of copper or copper alloy so as to have a resistance value less than or equal to one-tenth of the resistance R of the glow plug.

Reference numeral 10 designates a comparator connected to middle points $m_1$ and $m_2$ of both lines 4*a* and 4*b*. Comparator 10 produces an output signal on an output terminal 10*a* thereof when the following equation (1) is established.

$$\frac{r_2 + r_3}{r_1} \geqq \frac{r_4}{R} \qquad (1)$$

Reference numeral 11 designates a signal delay circuit and reference numeral 12 a relay contact operating means such as a relay coil. The relay contact operating means operates a current control element connected between the key switch and the bridge circuit 4, for example, a relay contact 13. Reference characters 13*a* and 13*b* indicate contact points thereof.

Reference numeral 14 designates a transmission signal converting amplifier of the self-holding type, reference numeral 15 a starter relay, and reference numeral 16 a starter. They are, as shown in FIG. 1, connected to form a control circuit 17.

Figure 2:
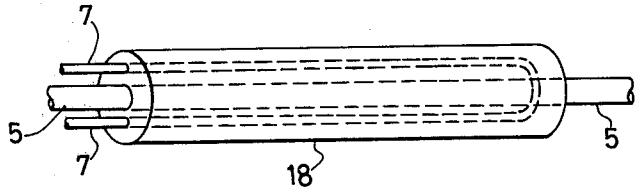
FIG. 2 is an enlarged view showing the arrangement of the third resistor 7 with respect to the first resistor 5 of the embodiment of FIG. 1.

It is desirable to provide the third resistor 7 with an electrically insulating but at least somewhat thermally conducting coating layer 18 adjacent to the first resistor 5 as shown in FIG. 2 to closely thermally couple the two resistors in order to more effectively match their temperature-induced variations in resistance values.

Operationally, upon starting the engine, when the key switch 2 is closed, an electric current from the power supply 1 flows through the closing contact point 13*a* of the relay to the resistors 5, 8 (6, 7), 9 and the heat generating element 31 of the Wheatstone bridge.

While the heat generating element 31 heats up to the set temperature Ts, the resistance $r_1$ of the first resistors 5 increases slightly in correspondence with the temperature rise of element 31. If the resistors 6 and 7 were to both have constant resistances, the resistance R of the heat generating element would increased to the point at which the above-described equation (1) is satisfied and would continue to increase finally exceeding the resistance value Rs corresponding to the melting temperature and would destroy the heat generating element 31.

However, in accordance with the present invention, since the third resistor 7 has a resistance value $r_3$ corresponding to the temperature variation of the resistor 5 and has a positive temperature coefficient, as the resistance $r_1$ of the resistor 5 increases in accordance with the temperature rise, the resistance $r_2+r_3$ of the resultant resistor 8 increases as well. Accordingly, the resistance Rs corresponding to the set temperature of the resistance R satisfying the above equation (1) is prevented from increasing excessively.

When the resistance R reaches the set resistance Rs thereby satisfying the above equation (1), the comparator 10 operates to produce an output signal on the output terminal 10*a*. The output signal from the comparator 10 is converted from a low power signal into a suitably high power electrical signal by the amplifier 14 and coupled to the contact point operating means 12. The change-over from the contact point 13*a* to the contact point 13*b* is then brought about by the operating device 12 to thereby open the contact point 13*a* within a short time after the output signal from comparator 10 is produced. Accordingly, within the Wheatstone bridge, current flow through the glow plug 31 is temporarily stopped. When the current flow is stopped, the resistance value R decreases and the output signal from the comparator 10 is consequently interrupted. The contact point 13*a* is again closed to heat the glow-plug until the temperature of the glow plug reaches the set temperature corresponding to the resistance Rs. Then, when the resistance R of the glow plug reaches the set resistance Rs, the output signal from the comparator 10 is again produced thereby repeating the operation described above. By repeatedly operating the relay contact point operating means 12, the temperature of the heat generating element 31 is maintained approximately at the set temperature. With the device of the present invention constructed and operated as described above, the first resistor 5 of which the resistance value $r_1$ is very small and is variable according to its temperature variation, can be implemented by a section of an appropriate wire which is connected to the heat generating element 31 in the line 4*a* of the bridge circuit.

Furthermore, since the first resistor 5 has a very small resistance $r_1$, it is possible to supply a large amount of current to the heat generating element 31. As a result, more rapid heating is possible to thereby considerably reduce the time period required for preheating the engine.

In the embodiment described, the transmission signal converting amplifier are preferably of the self-holding type. The starter relay 15 and/or the above described amplifier 14 may also be of the self-holding type.

The relationships between the resistance-temperature coefficient $\alpha$ of the first resistor 5 ($r_1$) and the resistance-temperature coefficient $\beta$ of the third resistor 7 ($r_3$) will be described in detail.

In order to establish the equation of $$\frac{r_2 + r_3}{r_1} = \frac{r_4}{R} \qquad (1'),$$

the resistance, ($r_2$) and ($r_3$) must be chosen as follows.

$$r_1 = r_{10}(1+\alpha T)$$

where $r_{10}$ is the resistance value of the first resistor at the room temperature and T is the ambient temperature.

$$r_3 = r_{30}(1+\beta T)$$

where $r_{30}$ is the resistance value of the third resistor at the room temperature.

Therefore, $$\frac{r_2 + r_3}{r_1} = \frac{r_2 + r_{30}(1 + \beta T)}{r_{10}(1 + \alpha T)} = \frac{r_2 + r_{30} + r_{30}\beta T}{r_{10}(1 + \alpha T)} = \frac{(r_2 + r_{30})\left(1 + \frac{r_{30} \cdot \beta}{r_2 + r_{30}} \cdot T\right)}{r_{10}(1 + \alpha T)}$$

Accordingly, in order to establish $$\alpha = \frac{r_{30}}{r_2 + r_{30}}\beta,$$

the resistance values $r_2$ and $r_{30}$ must be chosen. As a result, the temperature compensation can be automatically achieved according to the present invention. The resistance value $r_3$ of the third resistor has the positive resistance-temperature coefficient variable according to the temperature variation so that the resistance-temperature coefficient thereof is compensated for to substantially the same value as that of the first resistor ($r_1$) depending on the constant resistance value $r_2$ of the second resistor.

As mentioned above, the present invention provides an engine start enhancement device in which the required preheating time is considerably reduced and which has a simple construction with excellent starting characteristics.

What is claimed is:

1. In an engine start enhancement device adapted to be connected to a power supply through a key switch, the improvement comprising a first resistor having resistance $r_1$ and having a positive temperature coefficient and a heat generating element of a glow plug having a resistance R connected in series, a second resistor having a predetermined constant resistance $r_2$ and a third resistor having a resistance $r_3$ which varies according to the temperature variation of resistance of said first resistor and having a positive temperature coefficient and a fourth resistor having a predetermined constant resistance $r_4$ connected in series with end terminals of the series combination connected to end terminal of the series combination of said first resistor and said heat generating element to form a bridge circuit, and a comparator connected to middle points of said bridge circuit, said comparator producing an output signal when $(r_2+r_3)/r_1 \geqq r_4/R$, and means for disconnecting the power supply from said bridge circuit is response to said output signal from said comparator.

2. The start enhancement device of claim 1 wherein said first resistor and said third resistor are thermally coupled to one another.

3. A start enhancement device for operating the glow plugs of a diesel engine comprising:

an electrically operated relay connected to switch current from a first terminal of a battery;

a first resistor, said first resistor being connected in series with a glow plug and the series combination of said first resistor and said glow plug being connected between an output terminal of said relay and a second terminal of said battery;

second, third and fourth resistors coupled in series with one another, said third resistor being thermally coupled to said first resistor and said third resistor having a positive temperature coefficient of resistance corresponding to the temperature coefficient of resistance of said first resistor, and the series combination of said second, third and fourth resistors being coupled between said output terminal of said relay and said second terminal of said battery with a first terminal of said fourth resistor being coupled to the same of said output terminal of said relay and said second terminal of said battery as one terminal of said glow plug;

comparator means having one input terminal coupled to the juncture between said first resistor and said glow plug and a second terminal coupled to a second terminal of said fourth resistor; and means for operating said relay in response to an output signal produced by said comparator means.

4. The start enhancement device of claim 3 wherein the resistance value of said first resistor is substantially less than the resistance value of said glow plug.

5. The start enhancement device of either of claims 3 and 4 wherein said first resistor comprises a section of wire comprising copper and further comprising a body of electrically insulating material covering at least portions of said first and third resistors.

* * * * *